US007669733B2

(12) United States Patent
Kim

(10) Patent No.: US 7,669,733 B2
(45) Date of Patent: Mar. 2, 2010

(54) CASSETTE DEVICE FOR AUTOMATIC MEDICINE PACKAGING APPARATUS

(76) Inventor: Jun Ho Kim, 100-23, Galsandong, Dalsuhgu, Taegu (KR)

( * ) Notice: Subject to any disclaimer, the term of this patent is extended or adjusted under 35 U.S.C. 154(b) by 620 days.

(21) Appl. No.: 11/594,591

(22) Filed: Nov. 8, 2006

(65) Prior Publication Data

US 2008/0099499 A1 May 1, 2008

(30) Foreign Application Priority Data

Nov. 1, 2006 (KR) ..... 10-2006-0107321

(51) Int. Cl.
*B65H 3/00* (2006.01)

(52) U.S. Cl. ..... 221/265; 221/263; 221/261; 221/277

(58) Field of Classification Search ..... None
See application file for complete search history.

(56) References Cited

U.S. PATENT DOCUMENTS

| | | | |
|---|---|---|---|
| 169,935 | A | 11/1875 | Whitman |
| 350,675 | A | 10/1886 | Hathaway |
| 488,721 | A | 12/1892 | Stempel |
| 1,121,804 | A | 12/1914 | Coulson |
| 1,270,756 | A | 6/1918 | Holmberg |
| 1,912,248 | A | 5/1933 | Bateman et al. |
| 2,005,496 | A | 6/1935 | Cleveland |
| 2,181,314 | A | 11/1939 | Burns |
| 2,208,951 | A | 7/1940 | Tamassy |
| 2,255,036 | A | 9/1941 | Gedge |
| 2,449,139 | A | 9/1948 | Posner |
| 2,710,712 | A | 6/1955 | Friedman |
| 2,712,883 | A | 7/1955 | Esposito et al. |
| 2,916,069 | A | 12/1959 | Brown, Jr. et al. |
| 2,994,996 | A | 8/1961 | Klar |
| 3,074,214 | A | 1/1963 | Schneider et al. |
| 3,227,127 | A | 1/1966 | Gayle |
| 3,263,857 | A | 8/1966 | Krakauer et al. |
| 3,348,392 | A | 10/1967 | Schreiber |
| 3,408,876 | A | 11/1968 | Andrews |
| 3,410,452 | A | 11/1968 | Igel et al. |
| 3,481,103 | A | 12/1969 | Summerour |

(Continued)

FOREIGN PATENT DOCUMENTS

| | | |
|---|---|---|
| GB | 2178397 | 2/1987 |

(Continued)

*Primary Examiner*—Gene Crawford
*Assistant Examiner*—Timothy R Waggoner
(74) *Attorney, Agent, or Firm*—John K. Park; Park Law Firm

(57) ABSTRACT

A cassette device for an automatic medicine packaging apparatus includes a cassette main body that contains medicine, a dispensing block that aligns medicine for dispensing according to a prescription and a partitioning member that blocks medicine from discharging from the cassette main body and allows medicine to be discharged only when the partitioning member is controlled to discharge medicine according to the prescription. The partitioning member includes a non-deforming portion and a deforming portion that is connected to the non-deforming portion. The non-deforming portion contacts medicine aligned in the dispensing block. The deforming portion deforms when as external force is applied whereby the non-deforming portion can be displaced.

10 Claims, 6 Drawing Sheets

U.S. PATENT DOCUMENTS 3,546,849 A 12/1970 Zimmerman
3,562,475 A 2/1971 Angelotti et al.
3,604,559 A 9/1971 McCall et al.
3,774,368 A 11/1973 Paprzycki
3,820,655 A 6/1974 La Tourette et al.
3,830,419 A 8/1974 Lee
3,842,569 A 10/1974 McClelland et al.
3,850,780 A 11/1974 Crawford et al.
3,861,651 A 1/1975 Takamura
3,871,158 A 3/1975 Koenig et al.
3,921,419 A 11/1975 Rosenkranz et al.
3,990,209 A 11/1976 Eisenberg
4,019,547 A 4/1977 Ross
4,149,394 A 4/1979 Sornes
4,209,211 A 6/1980 Alford
4,244,158 A 1/1981 Nelham
4,254,601 A 3/1981 Prager et al.
4,267,942 A 5/1981 Wick, Jr. et al.
4,382,527 A 5/1983 Lerner
4,519,179 A 5/1985 Meier
4,534,499 A 8/1985 Cox et al.
4,572,376 A 2/1986 Wrennall
4,664,289 A 5/1987 Shimizu et al.
4,696,392 A 9/1987 Chisholm, Jr.
4,771,912 A 9/1988 van Wingerden
4,790,118 A 12/1988 Chilcoate
4,790,421 A 12/1988 Gorges
4,811,764 A 3/1989 McLaughlin
4,903,861 A 2/1990 Yuyama
4,915,259 A 4/1990 Guigan et al.
4,922,682 A 5/1990 Tait et al.
4,955,178 A 9/1990 Shroyer
5,069,511 A 12/1991 Swets et al.
5,097,652 A 3/1992 Inamura et al.
5,219,095 A 6/1993 Shimizu et al.
5,221,024 A 6/1993 Campbell
5,318,430 A 6/1994 Ramm
5,337,919 A 8/1994 Spaulding et al.
5,348,061 A 9/1994 Riley et al.
5,381,904 A 1/1995 Thurell
5,383,559 A 1/1995 Toren
5,413,245 A 5/1995 Wright
5,441,165 A 8/1995 Kemp et al.
5,459,983 A 10/1995 Sadek et al.
5,481,855 A 1/1996 Yuyama
5,487,289 A 1/1996 Otto, III et al.
5,502,944 A 4/1996 Kraft et al.
5,509,573 A 4/1996 Campoli
5,522,525 A 6/1996 McLaughlin et al.
5,575,465 A 11/1996 Auerbach et al.
5,588,792 A 12/1996 Tiso
5,599,015 A 2/1997 Shimizu et al.
5,611,456 A 3/1997 Kasper
5,626,219 A 5/1997 Deefholts et al.
5,651,476 A 7/1997 Percy et al.
5,660,305 A 8/1997 Lasher et al.
5,667,096 A 9/1997 Wu
5,671,592 A 9/1997 Yuyama et al.
5,678,393 A 10/1997 Yuyama et al.
5,709,063 A 1/1998 Yuyama et al.
5,722,215 A 3/1998 Yuyama
5,749,117 A 5/1998 Forsline
5,765,606 A 6/1998 Takemasa et al.
5,787,678 A 8/1998 Koike et al.
5,797,248 A 8/1998 Hetherington et al.
5,803,309 A 9/1998 Yuyama et al.
5,819,500 A 10/1998 Haraguchi et al.
5,839,257 A 11/1998 Soderstrom et al.
5,852,911 A 12/1998 Yuyama et al.
5,865,342 A 2/1999 Ito et al.
5,875,610 A 3/1999 Yuyama et al.
5,901,876 A 5/1999 Yuyama et al.
5,927,546 A * 7/1999 Yuyama et al. ..... 221/265
5,930,145 A 7/1999 Yuyama et al.
5,944,057 A 8/1999 Pierce
5,946,883 A 9/1999 Yuyama et al.
5,963,453 A 10/1999 East
5,964,374 A 10/1999 Yuyama et al.
5,987,859 A 11/1999 Dreger
6,012,602 A 1/2000 Yuyama et al.
6,023,916 A 2/2000 Bouthiette
6,029,683 A 2/2000 Moebs et al.
6,050,064 A 4/2000 Yuyama et al.
6,089,136 A 7/2000 Hinojosa et al.
6,109,486 A 8/2000 Lee, Jr. et al.
6,119,440 A 9/2000 Benner, Jr. et al.
6,119,892 A 9/2000 Laurent et al.
6,145,700 A 11/2000 Takahashi et al.
6,164,038 A 12/2000 Kim
6,170,229 B1 1/2001 Kim
6,170,230 B1 1/2001 Chudy et al.
6,170,699 B1 1/2001 Kim
6,179,205 B1 1/2001 Sloan
6,202,385 B1 3/2001 Kim
6,216,418 B1 4/2001 Kim
6,256,963 B1 7/2001 Kim
6,263,639 B1 7/2001 Kim
6,273,335 B1 8/2001 Sloan
6,308,494 B1 10/2001 Yuyama et al.
6,311,743 B1 11/2001 Baroncini
6,318,051 B1 11/2001 Preiss
6,349,848 B1 2/2002 Uema et al.
6,364,517 B1 4/2002 Yuyama et al.
6,367,232 B2 4/2002 Kim
6,394,308 B1 5/2002 Yuyama et al.
6,409,290 B1 6/2002 Lin
6,427,865 B1 8/2002 Stillwell et al.
6,449,921 B1 9/2002 Kim
6,457,611 B1 10/2002 Koehler
6,471,089 B2 10/2002 Liff et al.
6,471,090 B1 10/2002 Inamura et al.
6,478,185 B2 11/2002 Kodama et al.
6,481,180 B1 11/2002 Takahashi et al.
6,508,279 B2 1/2003 Siegel et al.
6,540,101 B1 4/2003 Kim
6,581,356 B2 6/2003 Kim
6,585,132 B2 7/2003 Kim
6,604,019 B2 8/2003 Ahlin et al.
6,611,733 B1 8/2003 De La Huerga
6,644,504 B2 11/2003 Yuyama et al.
6,647,702 B1 11/2003 Kim
6,722,167 B1 4/2004 Hsu
6,772,907 B2 8/2004 Kim
6,786,356 B2 * 9/2004 Geiger et al. ..... 221/199
6,792,736 B1 9/2004 Takahashi
6,805,259 B2 10/2004 Stevens et al.
6,898,919 B2 5/2005 Kim
7,028,447 B2 4/2006 Sung
7,059,098 B2 6/2006 Kim
7,331,151 B2 2/2008 Kim
7,510,099 B2 * 3/2009 Knoth et al. ..... 221/265
2002/0092275 A1 7/2002 Kim
2003/0057225 A1 3/2003 Kim
2003/0074868 A1 4/2003 Yasuoka et al.
2004/0046020 A1 3/2004 Andreasson et al.
2004/0129716 A1 7/2004 Naufel et al.
2004/0182044 A1 9/2004 Kim
2005/0179349 A1 8/2005 Booth et al.
2005/0234430 A1 10/2005 Mao et al.
2006/0058918 A1 3/2006 Handfield et al.
2006/0070352 A1 4/2006 Momich
2006/0139148 A1 6/2006 Faro et al.
2006/0267727 A1 11/2006 Cayne et al.
2006/0273106 A1 12/2006 Kim

| | | | |
|---|---|---|---|
| 2007/0016327 | A1 | 1/2007 | Yuyama et al. |
| 2007/0078562 | A1 | 4/2007 | Park |
| 2007/0125100 | A1 | 6/2007 | Shoenfeld |
| 2007/0151204 | A1 | 7/2007 | Kim |
| 2007/0208595 | A1 | 9/2007 | Ohmura et al. |
| 2007/0257773 | A1 | 11/2007 | Hill et al. |

FOREIGN PATENT DOCUMENTS

| | | |
|---|---|---|
| JP | 9-175510 | 7/1997 |
| JP | 9-266940 | 10/1997 |

* cited by examiner

CASSETTE DEVICE FOR AUTOMATIC MEDICINE PACKAGING APPARATUS

CLAIMING FOREIGN PRIORITY

The applicant claims and requests a foreign priority, through the Paris Convention for the Protection of Industrial Property, based on patent applications filed in the Republic of Korea (South Korea) with the filing date of Nov. 1, 2006 with the patent application number 10-2006-0107321 by the applicant, the contents of which are incorporated by reference into this disclosure as if fully set forth herein.

BACKGROUND OF THE INVENTION

The present invention relates to a cassette device for automatic medicine packaging apparatus. More particularly, the present invention relates to a cassette device for automatic medicine packaging apparatus that includes a partitioning member that prevents damage of tablets during dispensing of the tablets.

An automatic medicine packaging apparatus has been widely used to continuously package medicines per dose. The medicines are selected from multiple cassettes that contain different tablets or capsules.

A cassette device for such an automatic medicine packaging apparatus includes a cassette main body that contains medicines of various size and shape, a dispensing block that is rotatably received in the cassette main body and separates and discharges medicine, a cassette base that supports the cassette main body and encloses a motor that rotates the dispensing block, and a partition member that is installed in the cassette main body and makes the dispensing block dispense predetermined amount of medicine.

A plurality of feeding grooves are provided on the outer peripheral surface of the dispensing block, and the tablets contained in the cassette main body are discharged out of the cassette through these feeding grooves. The partitioning member is required to block the feeding groove so that only predetermined amount of tablets is dispensed.

Japan Laid-Open Patent Publication No. (Hei)9-266,940 discloses a partitioning member that is made by bending metal plate. This prior art partitioning member is formed by bending part of partitioning member body substantially perpendicularly. A through hole is formed on one side of the partitioning member body. A fastener is inserted into this through hole and fastened so that the partitioning member is fixed to the cassette main body. While this partitioning member is easy to manufacture and can partition tablets well, it has disadvantages to scratch surface of tablets or to break edges of tables when the partitioning member climbs over superposed tablets which have thin edges.

U.S. Pat. No. 5,803,309 discloses a partitioning member that includes comb-shaped partitioning portion. The comb-shaped partitioning member is integrally formed with synthetic resin. A through hole is provided on one side of the body of the partitioning member, into which a fastener is inserted to fix the partitioning member to the cassette main body. While the comb-shaped partitioning portion does not damage tablets even though it climbs over superposed tablets, it has disadvantages that elaborate manufacturing process is required to injection mold the many thin teeth of the comb, and the teeth are prone to deformation or fracture by tablets. When the teeth are deformed or broken, and as a result the gaps between adjacent teeth become not constant, the partitioning is not performed properly and tablets that are more than the predetermined amount may be dispensed.

A partitioning member that can precisely partition tablets, prevent damage or fracture of tablets, and also prevent deformation or fracture of itself has long been in need.

SUMMARY OF THE INVENTION

The present invention contrives to solve the disadvantages of the prior art.

An objective of the invention is to provide a partitioning member for a medicine cassette of an automatic medicine packaging apparatus, which is durable and easy to manufacture.

Another objective of the invention is to provide a partitioning member that deforms freely to treat irregularities of tablet positioning in a dispensing block of the medicine cassette.

In order to achieve the above objective, the present invention provides a cassette device for an automatic medicine packaging apparatus, which includes a cassette main body that is adapted to contain medicine, a dispensing block that is adapted to align medicine for dispensing according to a prescription, and a partitioning member that is adapted to block medicine from discharging from the cassette main body and to allow medicine to be discharged only when the partitioning member is controlled to discharge medicine according to the prescription.

The partitioning member includes a non-deforming portion and a deforming portion that is connected to the non-deforming portion. The non-deforming portion is adapted to contact medicine aligned in the dispensing block. The deforming portion deforms when as external force is applied whereby the non-deforming portion can be displaced.

The deforming portion includes a flexing portion that includes one or more arc-shaped portions.

The non-deforming portion includes a fixing bracket that is fixed to the cassette main body, a movable portion, and a support portion that protrudes from the movable portion. The flexing portion connects between the fixing bracket and the movable portion. The fixing bracket includes one or more through holes.

The support portion is substantially orthogonal with the movable portion. The support portion is adapted to partition medicine aligned in the dispensing block.

The dispensing block includes a block body, a plurality of dividing projections that are formed on the outer periphery of the block body, a plurality of feeding grooves that are formed between the dividing projections, and a dividing groove that is formed traverse to the dividing projections. The support portion of the partitioning member is positioned in the dividing groove.

Alternatively, the dispensing block includes a block body, a plurality of dividing projections that are formed on the outer periphery of the block body, and a plurality of feeding grooves that are formed between the dividing projections. The support portion of the partitioning member is positioned at the upper end of the feeding groove.

The arc-shaped portions of the flexing portion are convex opposite to the direction in which the support portion protrudes from the movable portion.

Alternatively, the arc-shaped portions of the flexing portion are convex in the same direction in which the support portion protrudes from the movable portion.

The support portion has a shape of a substantially thin plate. The support portion includes two side edges that are formed as blades, and an edge that faced toward the dispensing block. The edge is concave arc-shaped.

The advantages of the present invention are: (1) the partitioning member provides reliable partitioning and dispensing operations for tablets contained in the medicine cassette; (2) the partitioning member does not damage or break medicine during its operation; and (3) the partitioning member is durable and easy to manufacture, and is not prone to damage or fracture.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

In the present invention, medicine means every solid medication that has a predetermined shape including tablets, capsules, etc.

Figure 1:
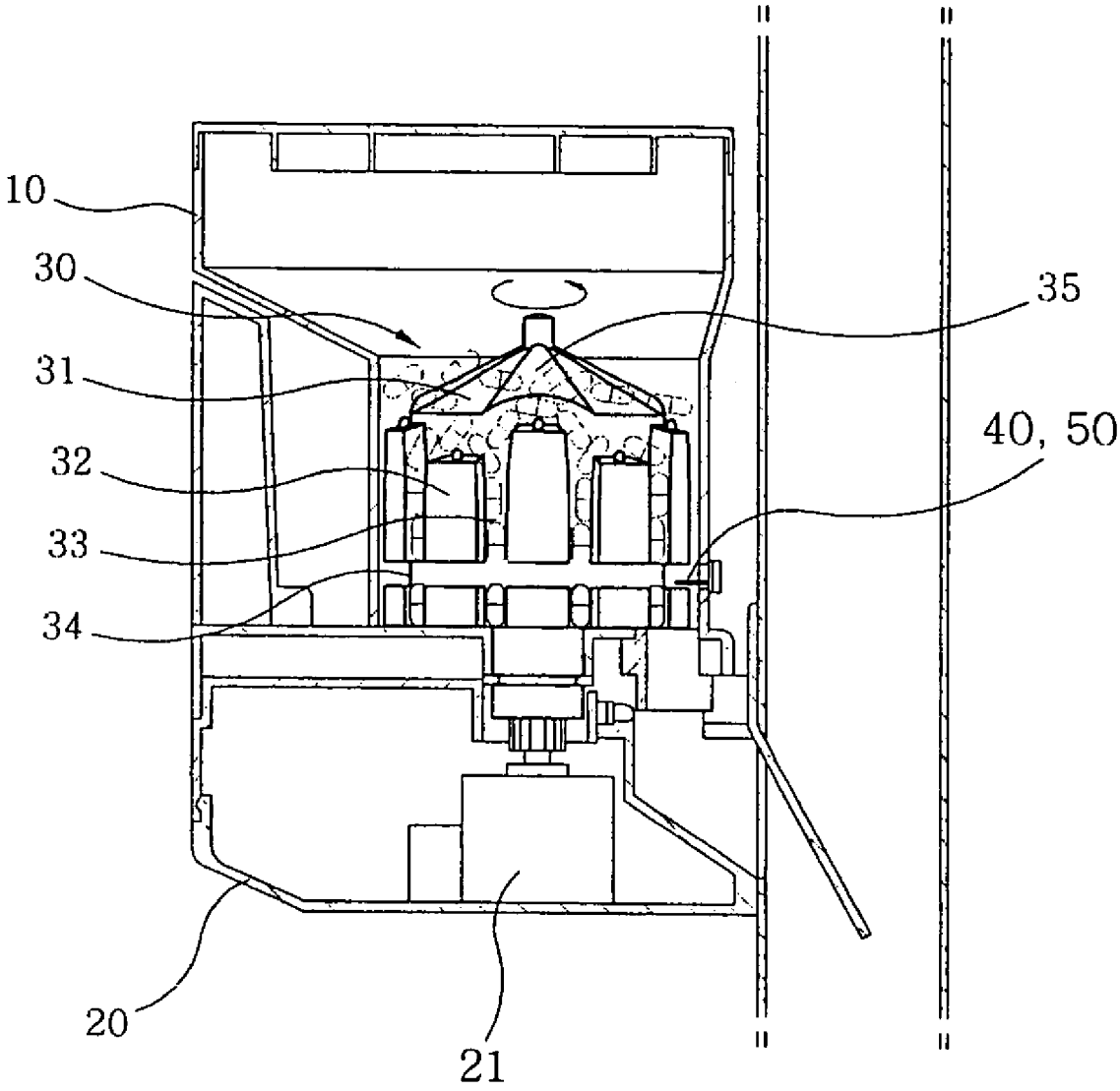
FIG. 1 is a cross-sectional view showing a cassette device for automatic medicine packaging apparatus according to the present invention.

FIG. 1 shows a cassette device for an automatic medicine packaging apparatus that can pack various medicines per dose continuously. The cassette device includes a cassette main body 10 that contains medicines of various size and shape, a dispensing block 30 that is rotatably received in the cassette main body 10 and separates and discharges medicine, a motor 21 that rotates the dispensing block 30, a cassette base 20 that supports the cassette main body 10, and a partition member 40, 50 that is installed in the cassette main body 10 and makes the dispensing block 30 dispense predetermined amount of medicine.

The dispensing block 30 has a generally cylindrical shape. Medicines are contained above the dispensing block 30. The medicine is aligned as the dispensing block 30 is rotated and discharged as explained below.

The cassette main body 10 has a structure so that it is separable from the cassette base 20 for maintenance including refilling medicine or cleaning. A rotation shaft of the dispensing block is detachably attached to a rotation shaft of the motor 21. For example, a male gear may by provided on the rotation shaft of the motor 21, and a corresponding female gear may be provided to the rotation shaft of the dispensing block 30.

Figure 2:
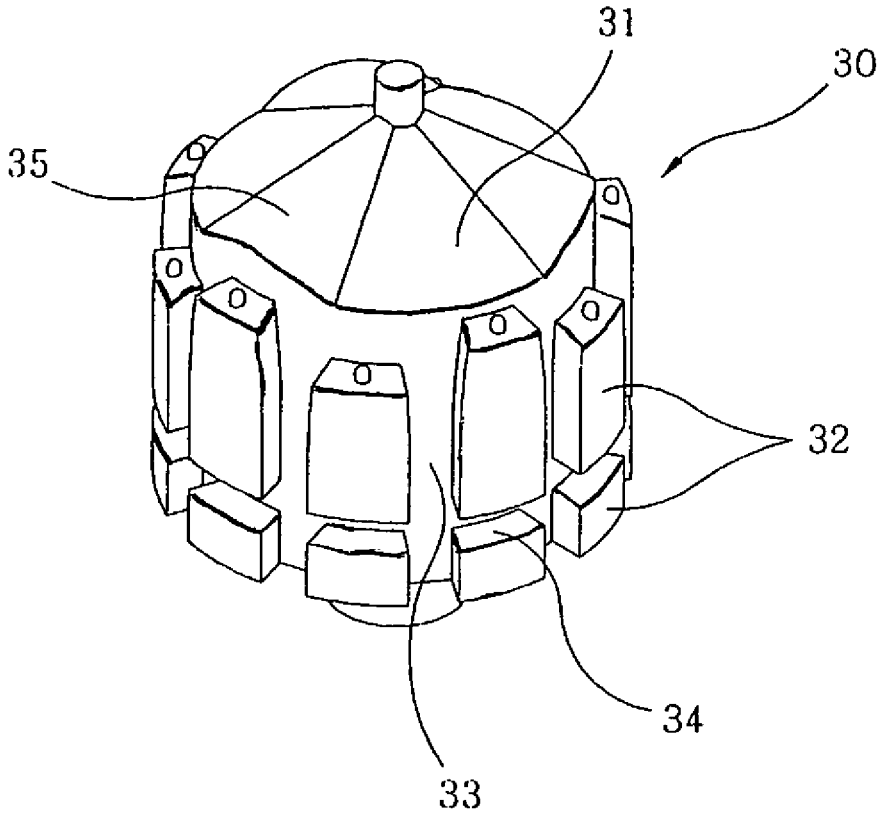
FIG. 2 is a perspective view showing a cylindrical dispensing block that is provided in the cassette device.

FIG. 2 shows that the dispensing block 30 includes a block body 31, the upper portion of which is generally cone-shaped, a plurality of dividing projections 32 that are formed on the outer periphery of the block body 30, a plurality of longitudinal feeding grooves 33 that are formed between the dividing projections 32, and a dividing groove 34 that is formed transverse to the dividing projections 32.

A plurality of convex portions 35 are formed on the cone-shaped top portion of the block body 30. The convex portions 35 are spaced from one another. The convex portions 35 facilitate random mixing of the medicines contained in the cassette main body 10 and preventing jamming of medicines that may occur when multiple tables are moved into the feeding groove 33 simultaneously. Also for this purpose, the heights of the dividing projections 32 differ from one another.

The medicines or tablets are discharged out of the cassette through the feeding grooves 33. The partitioning member 40, 50 blocks the feeding groove 33 so that only predetermined amount of medicine is discharged.

The dividing groove 34 is provided to prevent interference of the partitioning member with the dividing projections 32.

Figure 3A:
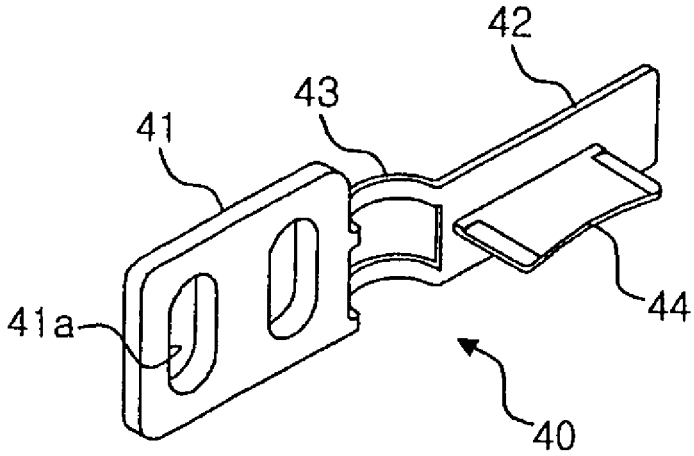
FIG. 3*a* is a perspective view showing a partitioning member according to a first embodiment of the invention.
Figure 3B:
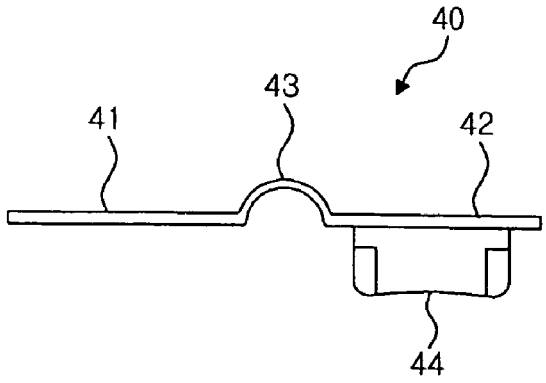
FIG. 3*b* is a plan view of the partitioning member.
Figure 3C:
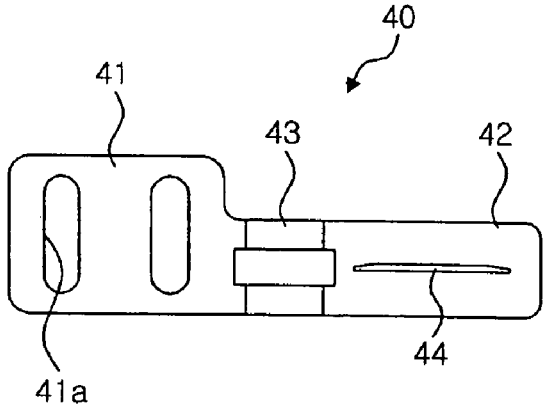
FIG. 3*c* is an elevation view of the partitioning member.

FIGS. 3*a*~3*c* show the partitioning member 40 according to the first embodiment of the invention. The partitioning member 40 includes a fixing bracket 41 that is assembled and fixed to the cassette main body 10, a movable portion 42, on which a support portion 44 protrudes vertically, and a flexing portion 43 that connects between the fixing bracket 41 and the movable portion 42. The support portion 44 partitions the tablets aligned in one column inside the feeding groove 33 and supports the tablet rests on the support portion 44.

One or more through holes 41*a* are formed on the fixing bracket 41. The through holes are slots that extend vertically. The partitioning member 40 is fixed to the cassette main body 10 inserting a fastener such as a screw (not shown) into the through hole 41*a*. The fixing position of the portioning member 40 may be adjusted vertically by adjusting the position of the fastener within the through hole 41*a*.

The support portion 44 has a shape of substantially thin plate, and the two side edges thereof are formed as blades so that it can easily partition the tablets rotating with the dispensing block 30. The shapes of the movable portion 42 and the support portion 44 are kept unchanged. The edge of the support portion 44 that faces toward the dispensing block 30 is concave arc-shaped so that it corresponds with the circular shape of the dispensing block.

The flexing portion 43 connects between the fixing bracket 41 and the movable portion 42 as two arc-shaped members. Since the fixing bracket 41 is fixed to the cassette main body 10, the support portion 44 is located within the dividing groove 34 having a certain positional flexibility provided by the flexing portion 43.

The support portion 44 is integrally formed with the movable portion 42 and the thin plate shape of the support portion 44 does not change. This facilitates partitioning of the tablets which may be overlapped in the feeding groove 33.

If an external force is exerted to the partitioning member 40, elastic deformation occurs at the flexing portion that has comparatively low strength. Thus, even if the support portion climbs over superposed tablets, the entire movable portion 42 including the support portion 44 retracts by the thickness of the tablet so that it does not damage the tablet.

Since the flexing portion 43 has an arc shape, it can accommodate various movements of the movable portion 42 that occur when the support portion 44 climbs over a tablet and thus is subject to an external force. The movements includes a backward pivoting movement that occurs when the moving portion 42 pivots backward, a translational movement when the moving portion 42 moves along its length, a vertical pivoting movement that occurs when the moving portion pivots up or down, and a torsion movement. The flexing strength of the flexing portion 43 can be adjusted by changing the thickness, width, number of connecting portions, or the radius of the arc.

Figure 4A:
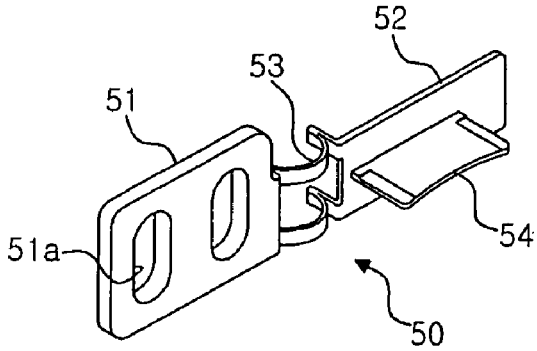
FIG. 4*a* is a perspective view showing a partitioning member according to a second embodiment of the invention.
Figure 4B:
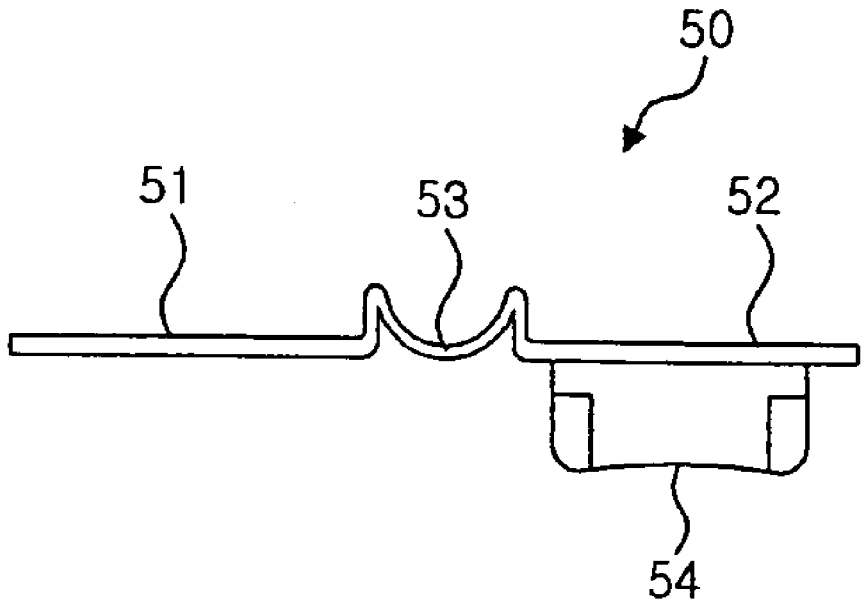
FIG. 4*b* is a plan view of the partitioning member.
Figure 4C:
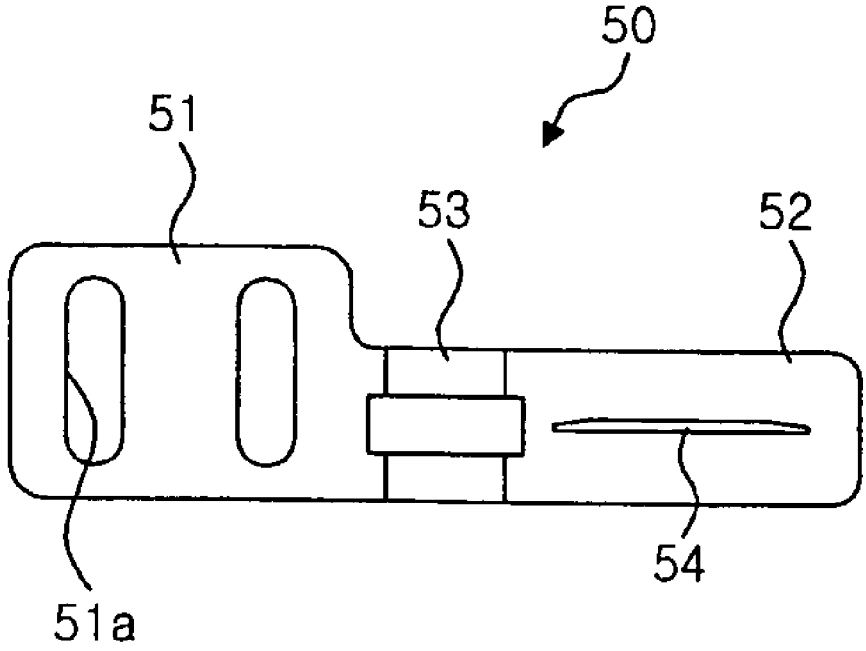
FIG. 4*c* is an elevation view of the partitioning member.

FIGS. 4*a*~4*c* show the partitioning member 50 according to the second embodiment of the invention. The partitioning member 50 includes a fixing bracket 51 that is assembled and fixed to the cassette main body 10, a movable portion 52, on which a support portion 54 protrudes vertically, and a flexing portion 53 that connects between the fixing bracket 51 and the movable portion 52. The support portion 54 partitions the tablets aligned in one column inside the feeding groove 33 and supports the tablet rests on the support portion 54. One or more through holes 51*a* are formed on the fixing bracket 51. The through holes are slots that extend vertically.

The partitioning member 50 is similar to the partitioning member 40. However, the flexing portion 53 of the partitioning member 50 is convex in the same direction in which the support portion 54 protrudes, and has roughly the shape of "M" as shown well in FIG. 4*b*. On the other hand, the flexing portion 43 of the partitioning member 40 is convex opposite to the protruding direction of the support portion 44 as shown well in FIG. 3*b*. While the particular shape of the flexing portion 53 is different from that of the flexing portion 43, the flexing portion 53 provides the same advantageous effects with the flexing portion 43.

The partitioning members 40, 50 are injection molded with polypropylene or any other material that are suitable for medical applications.

Figure 5:
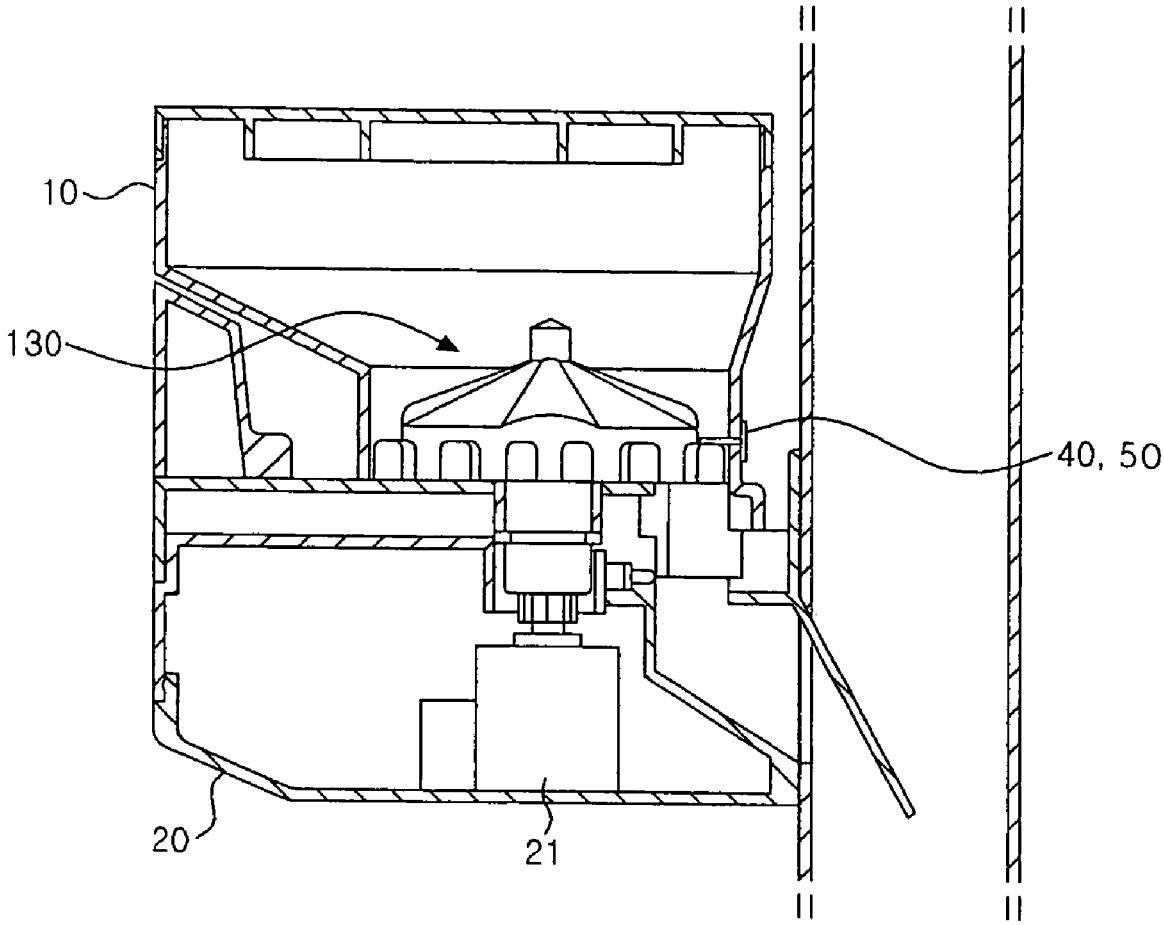
FIG. 5 is a cross-sectional view showing another cassette device.
Figure 6:
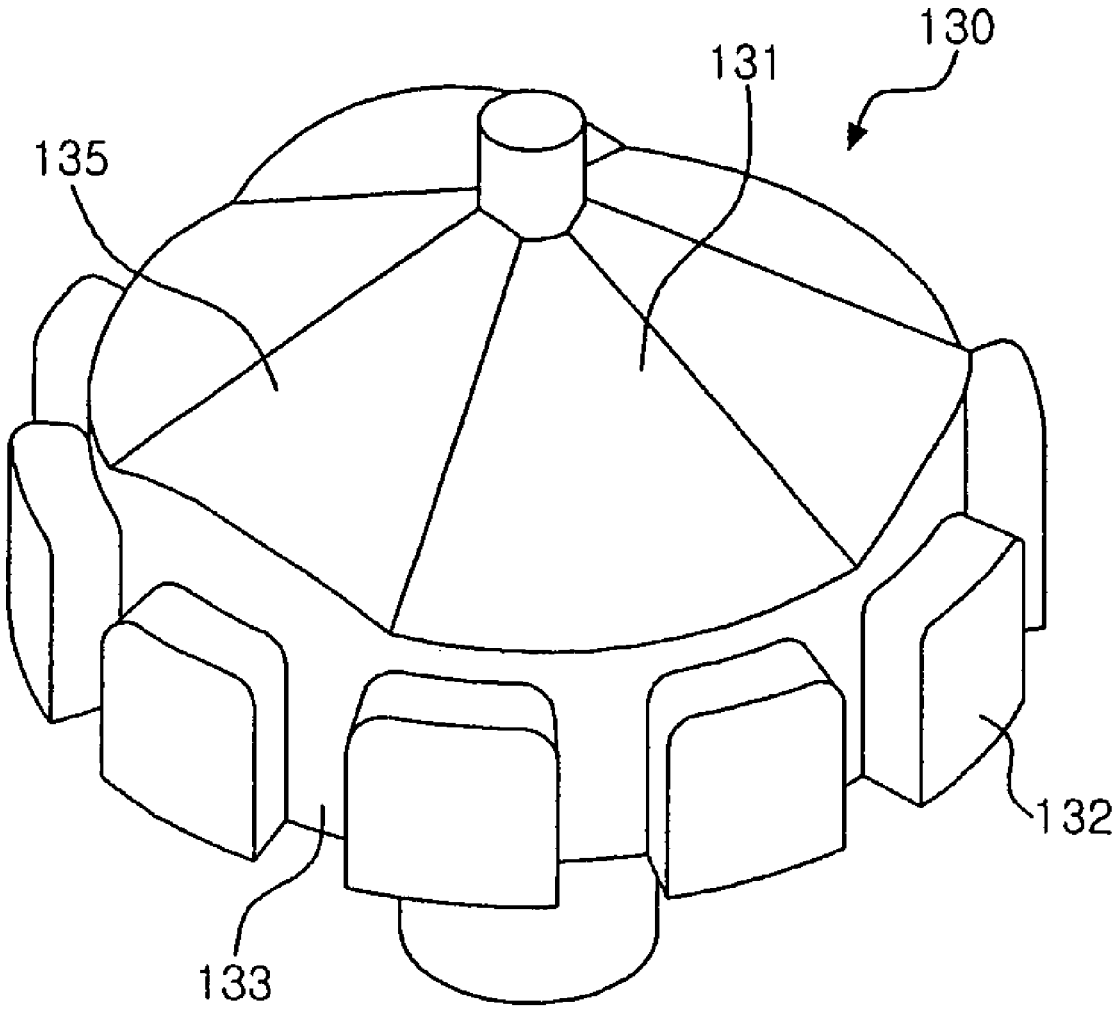
FIG. 6 is a perspective view showing another dispensing block.

FIGS. 5 and 6 show a dispensing block 130 that is different from the dispensing block 30 in that the dispensing block 130 does not have a dividing groove, and has a plurality of dividing projections 132 that have constant height.

The dispensing block 130 includes a block body 131, the upper portion of which is generally cone-shaped, a plurality of the dividing projections 132 that are formed on the outer periphery of the block body 130, and a plurality of longitudinal feeding grooves 133 that are formed between the dividing projections 132.

A plurality of convex portions 135 are formed on the cone-shaped top portion of the block body 130. The convex portions 135 are spaced from one another. The convex portions 135 facilitate random mixing of the medicines contained in the cassette main body 10 and preventing jamming of medicines that may occur when multiple tables are moved into the feeding groove 133 simultaneously.

The height of the dividing projections 132 is constant. As shown well in FIG. 5, the partitioning member 40, 50 is positioned to closely contact the upper surface of the dividing projection and the upper end of the feeding groove 133.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A cassette device for an automatic medicine packaging apparatus comprising:

a) a cassette main body that is adapted to contain medicine;

b) a dispensing block that is adapted to align medicine for dispensing according to a prescription; and c) a partitioning member that is adapted to block medicine from discharging from the cassette main body and to allow medicine to be discharged only when the partitioning member is controlled to discharge medicine according to the prescription;

wherein the partitioning member comprises a non-deforming portion and a deforming portion that is connected to the non-deforming portion, wherein the non-deforming portion is adapted to contact medicine aligned in the dispensing block, wherein the deforming portion deforms when as external force is applied whereby the non-deforming portion can be displaced;

wherein the deforming portion comprises a flexing portion that comprises one or more arc-shaped portions;

wherein non-deforming portion comprises a fixing bracket that is fixed to the cassette main body, a movable portion, and a support portion that protrudes from the movable portion, wherein the flexing portion connects between the fixing bracket and the movable portion;

wherein the support portion is substantially orthogonal with the movable portion, wherein the support portion is adapted to partition medicine aligned in the dispensing block; and wherein the arc-shaped portions of the flexing portion are convex opposite to the direction in which the support portion protrudes from the movable portion.

2. The cassette device of claim 1, wherein the fixing bracket comprises one or more through holes.

3. The cassette device of claim 1, wherein the dispensing block comprises a block body, a plurality of dividing projections that are formed on the outer periphery of the block body, a plurality of feeding grooves that are formed between the dividing projections, and a dividing groove that is formed traverse to the dividing projections, wherein the support portion of the partitioning member is positioned in the dividing groove.

4. The cassette device of claim 1, wherein the dispensing block comprises a block body, a plurality of dividing projections that are formed on the outer periphery of the block body, and a plurality of feeding grooves that are formed between the dividing projections, wherein the support portion of the partitioning member is positioned at the upper end of the feeding groove.

5. A cassette device for an automatic medicine packaging apparatus comprising:

a) a cassette main body that is adapted to contain medicine;

b) a dispensing block that is adapted to align medicine for dispensing according to a prescription; and c) a partitioning member that is adapted to block medicine from discharging from the cassette main body and to allow medicine to be discharged only when the partitioning member is controlled to discharge medicine according to the prescription;

wherein the partitioning member comprises a non-deforming portion and a deforming portion that is connected to the non-deforming portion, wherein the non-deforming portion is adapted to contact medicine aligned in the dispensing block, wherein the deforming portion deforms when as external force is applied whereby the non-deforming portion can be displaced;

wherein the deforming portion comprises a flexing portion that comprises one or more arc-shaped portions;

wherein non-deforming portion comprises a fixing bracket that is fixed to the cassette main body, a movable portion, and a support portion that protrudes from the movable portion, wherein the flexing portion connects between the fixing bracket and the movable portion;

wherein the support portion is substantially orthogonal with the movable portion, wherein the support portion is adapted to partition medicine aligned in the dispensing block; and wherein the arc-shaped portions of the flexing portion are convex in the same direction in which the support portion protrudes from the movable portion.

6. The cassette device of claim 5, wherein the fixing bracket comprises one or more through holes.

7. The cassette device of claim 5, wherein the dispensing block comprises a block body, a plurality of dividing projections that are formed on the outer periphery of the block body, a plurality of feeding grooves that are formed between the dividing projections, and a dividing groove that is formed traverse to the dividing projections, wherein the support portion of the partitioning member is positioned in the dividing groove.

8. The cassette device of claim 5, wherein the dispensing block comprises a block body, a plurality of dividing projections that are formed on the outer periphery of the block body, and a plurality of feeding grooves that are formed between the dividing projections, wherein the support portion of the partitioning member is positioned at the upper end of the feeding groove.

9. A cassette device for an automatic medicine packaging apparatus comprising:

a) a cassette main body that is adapted to contain medicine;

b) a dispensing block that is adapted to align medicine for dispensing according to a prescription; and c) a partitioning member that is adapted to block medicine from discharging from the cassette main body and to allow medicine to be discharged only when the partitioning member is controlled to discharge medicine according to the prescription;

wherein the partitioning member comprises a non-deforming portion and a deforming portion that is connected to the non-deforming portion, wherein the non-deforming portion is adapted to contact medicine aligned in the dispensing block, wherein the deforming portion deforms when as external force is applied whereby the non-deforming portion can be displaced;

wherein the deforming portion comprises a flexing portion that comprises one or more arc-shaped portions;

wherein non-deforming portion comprises a fixing bracket that is fixed to the cassette main body, a movable portion, and a support portion that protrudes from the movable portion, wherein the flexing portion connects between the fixing bracket and the movable portion;

wherein the support portion is substantially orthogonal with the movable portion, wherein the support portion is adapted to partition medicine aligned in the dispensing block; and wherein the support portion has a shape of a substantially thin plate, wherein the support portion comprises two side edges that are formed as blades, and an edge that faced toward the dispensing block, wherein the edge is concave arc-shaped.

10. The cassette device of claim 9, wherein the fixing bracket comprises one or more through holes.

* * * * *